US008477977B2

(12) United States Patent
Aquilina

(10) Patent No.: US 8,477,977 B2
(45) Date of Patent: Jul. 2, 2013

(54) HEARING DEVICE WITH USER CONTROL

(75) Inventor: Paul C. Aquilina, Kitchener (CA)

(73) Assignee: Phonak AG, Staefa (CH)

( * ) Notice: Subject to any disclaimer, the term of this patent is extended or adjusted under 35 U.S.C. 154(b) by 137 days.

(21) Appl. No.: 12/530,651

(22) PCT Filed: Mar. 14, 2007

(86) PCT No.: PCT/EP2007/052419

§ 371 (c)(1),
(2), (4) Date: Jan. 18, 2010

(87) PCT Pub. No.: WO2008/110210

PCT Pub. Date: Sep. 18, 2008

(65) Prior Publication Data

US 2010/0142736 A1 Jun. 10, 2010

(51) Int. Cl.
*H04R 25/00* (2006.01)

(52) U.S. Cl.
USPC ..... 381/323; 381/322; 381/312; 381/314

(58) Field of Classification Search
None
See application file for complete search history.

(56) References Cited

U.S. PATENT DOCUMENTS

| | | | | |
|---|---|---|---|---|
| 3,973,099 | A * | 8/1976 | Morris, Sr. | 200/511 |
| 4,449,774 | A | 5/1984 | Takashi et al. | |
| 4,599,496 | A * | 7/1986 | Lecklider | 200/1 B |
| 5,188,540 | A * | 2/1993 | Haertl et al. | 439/500 |
| 5,404,407 | A | 4/1995 | Weiss | |
| 5,463,692 | A * | 10/1995 | Fackler | 381/324 |
| 5,586,188 | A | 12/1996 | Renggli et al. | |
| 5,588,064 | A * | 12/1996 | McSwiggen et al. | 381/312 |
| 6,044,164 | A * | 3/2000 | Ach-Kowalewski | 381/314 |
| 6,731,770 | B1 * | 5/2004 | Vonlanthen | 381/330 |
| 6,851,048 | B2 * | 2/2005 | Armitage | 713/1 |

FOREIGN PATENT DOCUMENTS

EP 1753263 A2 2/2007

OTHER PUBLICATIONS

International Search Report for PCT/EP2007/052419, dated Feb. 20, 2008.

* cited by examiner

*Primary Examiner* — Duc Nguyen
*Assistant Examiner* — Taunya McCarty
(74) *Attorney, Agent, or Firm* — Pearne & Gordon LLP

(57) ABSTRACT

The hearing device comprises
a connector (2) having at least one electrical contact (6); and
a user control (8);
wherein said user control (8) comprises said at least one electrical contact (6). Typically, said connector is a connector for providing a communication connection to said hearing device. The user control can be a pushbutton switch. In one embodiment, said connector comprises at least two electrical contacts (6), and said user control comprises a shorting member (12) for shorting said at least two electrical contacts when operated. In one embodiment, said user control comprises an elastic member (14), which is deformed when said user control is operated, for resetting said user control into its original position. Through this, a small-size hearing device can be realized.
The method of operating a hearing device comprises the step of using at least one electrical contact (6) of a connector (2) of said hearing device as a part of a user control (8) of said hearing device.

18 Claims, 5 Drawing Sheets

HEARING DEVICE WITH USER CONTROL

TECHNICAL FIELD

The invention relates to the field of hearing devices. It relates to methods and apparatuses according to the opening clause of the claims.

Under a hearing device, a device is understood, which is worn in or adjacent to an individual's ear with the object to improve the individual's acoustical perception. Such improvement may also be barring acoustic signals from being perceived in the sense of hearing protection for the individual. If the hearing device is tailored so as to improve the perception of a hearing impaired individual towards hearing perception of a "standard" individual, then we speak of a hearing-aid device. With respect to the application area, a hearing device may be applied behind the ear, in the ear, completely in the ear canal or may be implanted.

BACKGROUND OF THE INVENTION

Hearing devices are preferably very small, in particular in the case of In-The-Ear (ITE) hearing devices such as In-The-Channel (ITC) or Completely-In-the-Channel (CIC) hearing devices, but also in case of Behind-The-Ear (BTE) hearing devices. Nevertheless, it is desirable to provide a hearing device with a user interface comprising at least one user control, which allows a user of the hearing device to provoke changes the functioning of the hearing device such as selecting a hearing program.

It is possible to minimize the size of a hearing device and nevertheless provide a user interface by providing a remote control operationally connectable to the hearing device, which comprises said user interface. However, the user has to carry the remote control in order to be able to use the user interface, and a remote control adds considerable cost to the purchase price of the hearing system.

It is desirable to provide for an alternative way of providing a small hearing device with a user interface.

SUMMARY OF THE INVENTION

Therefore, one object of the invention is to create a hearing device that does not have the disadvantages mentioned above. A hearing device shall be provided, which comprises at least one user control, the addition of which results in no or only a small increase of volume of said hearing device. In addition, the respective method of operating a hearing device shall be provided, and furthermore, a use of at least one electrical contact of a connector of a hearing device shall be provided.

Another object of the invention is to minimize the size of a hearing device.

Another object of the invention is to provide a hearing device with a user control at no or little increase in size of said hearing device.

Further objects emerge from the description and embodiments below.

At least one of these objects is at least partially achieved by apparatuses and methods according to the patent claims.

The hearing device comprises a connector having at least one electrical contact; and a user control;

wherein said user control comprises said at least one electrical contact.

Through this, said connector and said user control can share components, namely at least said at least one electrical contact. Thus, a small-size hearing device can be realized.

Most modern hearing devices comprise a connector, typically for exchanging data with an external device such as a personal computer, e.g., during fitting of the hearing device. Such a connector is not used during normal operation of the hearing device, but typically only when a hearing device professional such as a hearing device fitter or an audiologist adjusts or tests the hearing device. Accordingly, it is possible to make use of said connector or parts thereof for other purposes during normal operation of the hearing device. Electrical contacts of the connector are already connected to the hearing device's circuitry, so that monitoring the electrical status of said electrical contacts in an appropriate fashion is readily implementable.

One other purpose for which said electrical contacts can be used is for being involved in receiving user input. A user of the hearing device may want to change the functioning of the hearing device during normal operation of the hearing device. E.g., the user may want to change an audio processing parameter of the hearing device such as the output volume or select a different hearing program, or select one of several input units such as internal or external microphones. For accomplishing this, the user operates a user control such as a dial, wheel or switch, in particular a pushbutton.

The invention allows to miniaturize the hearing device by a combined use of components of said connector and said user control. Electrical contacts of said connector can be used as electrical contacts of the user control.

In one embodiment, said connector is a connector for providing a communication connection to said hearing device. This is a typical application for connectors at hearing devices. The connector can be used for loading data into the hearing device and/or for reading data from said hearing device.

In one embodiment, said connector comprises a socket. This is, how connectors are typically embodied in hearing devices. Sockets like the well-known CS44-type socket or other miniature sockets may be used.

In one embodiment, said user control is integrated in the hearing device during normal operation of the hearing device. This means that during normal hearing device operation said user control is attached to or is part of the hearing device, i.e. that the user control is not an item which is occasionally or temporally attached to the hearing device.

In one embodiment, said user control comprises a switch. A switch as user control is usually easily implementable and can be used for many applications. In particular, said switch can be a pushbutton.

In one embodiment, said connector comprises at least two electrical contacts. More particularly, said user control can comprise a shorting member for shorting said at least two electrical contacts when operated. This allows for a simple and safely functioning implementation of the user control. E.g., the electrical resistance between said at least two electrical contacts can be monitored, and a strong change (increase and/or decrease) of said resistance as it will occur, e.g., when shorting said at least two electrical contacts by operating the user control, can be used as a signal indicating that a switching has taken place and that a corresponding action such as changing the hearing program or the output volume shall take place.

Instead of shorting said at least two electrical contacts when operating the user control, it is also possible to interrupt an electrical connection between said at least two electrical contacts when operating the user control.

In one embodiment, said user control comprises an elastic member, which is deformed when said user control is operated, for resetting said user control into its original position. This allows to realize a user control that can be easily operated many times.

Such an elastic member can comprise a spring.

In one embodiment, said elastic member comprises a body substantially made of an elastomer.

Said elastic member may, e.g., be compressed (or expanded) by the user when said user control is operated. When the user stops operating the user control, energy stored in the elastic deformation of the elastic member can be used for reinstalling the original state of the elastic member, i.e., the deformation of the elastic member is undone.

In one embodiment, the said elastic member forms a seal sealing said connector during normal operation of the hearing device. For hearing devices worn in or near the ear, sweat and cerumen are a problem, in particular with respect to corrosion of metal parts of the hearing device.

Therefore, it can be advantageous to seal said connector, and in particular, said elastic member or more particularly a part thereof can be used to accomplish this task. An elastomer is particularly well suited for this.

In one embodiment, a portion of said user control is comprised in a covering member covering said connector during normal operation of the hearing device. Usually, said connector is covered by a covering member, which typically forms a part of the housing of the hearing device. Integrating said user control or a part thereof in such a covering member can therefore help to reduce the size of the hearing device. In addition, such a covering member is anyway already located close to the connector.

In one embodiment, said hearing device comprises a battery door for covering an energy supply member within said hearing device during normal operation of the hearing device and for allowing access to said energy supply member, wherein said battery door comprises said covering member. And/or said battery door comprises said portion of said user control. Most hearing devices comprise a battery door, which is closed during normal operation of the hearing device and can be opened when a new energy supply such as a new battery has to be inserted into the hearing device.

In one embodiment, said hearing device comprises a housing comprising a lever to which a portion of said user control is attached and which lever is rotated when said user control is operated. This allows for a precise and safe operation of the user control.

It is pointed out, that the above-described embodiments of the invention can be combined with each other.

The method of operating a hearing device comprises the step of using at least one electrical contact of a connector of said hearing device as a part of a user control of said hearing device.

For example, by operating said user control, a flow of electrical current through said at least one electrical contact can be changed, for example, an electrical connection between at least one connector of said hearing device and another electrical contact of said hearing device can be established or interrupted.

In one embodiment, said user control is integrated in the hearing device during normal operation of the hearing device.

In one embodiment, said method comprises the steps of establishing an electrical connection between at least two electrical contacts of said connector by operating said user control, which operating causes a shorting member of said user control to electrically contact said at least two electrical contacts; and detecting said establishment of said electrical connection.

In one embodiment, said user control comprises a pushbutton, and said operating said user control comprises pushing said pushbutton.

The use according to the invention is a use of at least one electrical contact of a connector of a hearing device as at least one electrical contact of a user control of said hearing device.

The advantages of methods and uses according to the invention correspond to the advantages of corresponding hearing device of the invention.

Further preferred embodiments and advantages emerge from the dependent claims and the figures.

BRIEF DESCRIPTION OF THE DRAWINGS

Below, the invention is described in more detail by means of examples and the included drawings. The figures show.

The reference symbols used in the figures and their meaning are summarized in the list of reference symbols. The described embodiments are meant as examples and shall not confine the invention.

DETAILED DESCRIPTION OF THE INVENTION

Figure 1:
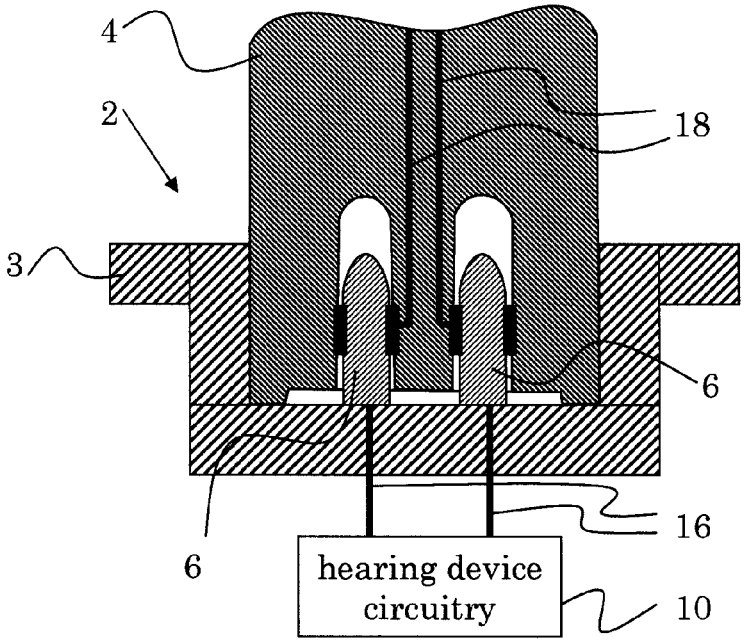
FIG. 1 a cross-section through a connector with plug attached, schematically.

FIG. 1 schematically shows a cross-section of a detail of a hearing device, more precisely, a cross-section through a connector 2, with a plug 4 attached, as it is known in the art. The connector 2, e.g., a CS44-type socket, is attached to or incorporated in a housing 3 of the hearing device and has electrical contacts 6, e.g., contact pins 6. These are connected via electrical connections 16 to the hearing device circuitry 10, i.e. to the electronics of the hearing device. When data shall be read from the hearing device or when data shall be loaded into the hearing device, plug 4 is connected to connector 2, so that the contact pins 6 are electrically contacted, so as to connect the connector 2 via electrical connections 18 to a device external to the hearing device, e.g., to a computer. Such a connection to an external device is used, e.g., during fitting of the hearing device or for updating the hearing device software.

As shown in FIG. 1, the electrical connection between plug 4 and connector 2 is typically made at the shaft of the contact pins 6.

Figure 2:
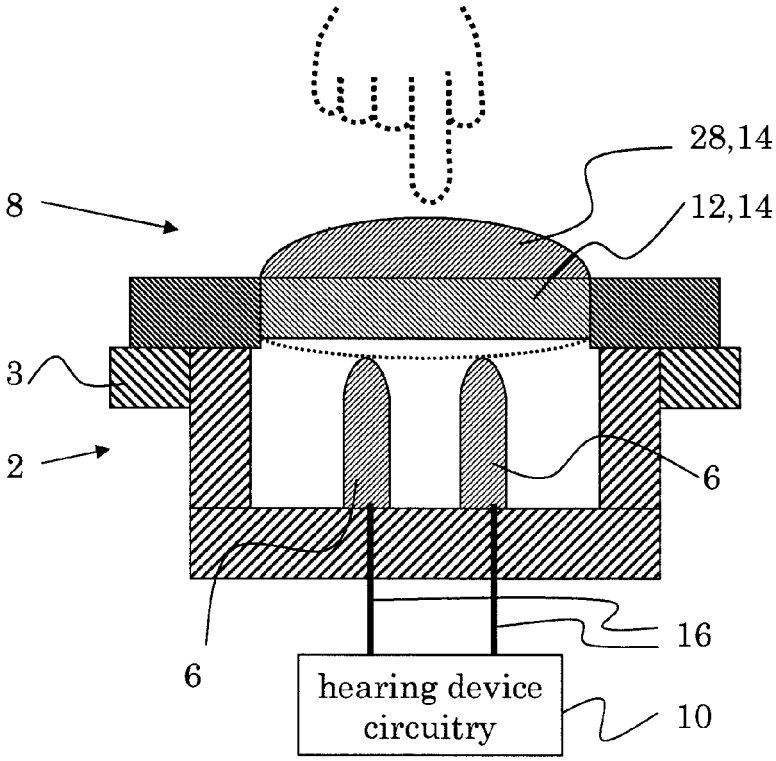
FIG. 2 a cross-section through a connector and user control, schematically.

FIG. 2 schematically shows a cross-section of a detail of a hearing device according to the invention, more precisely, a cross-section through a connector 2 and a user control 8. The connector 2 can be the same as the one in FIG. 1.

During normal operation of the hearing device, there is no plug applied to connector 2. Accordingly, it is possible to use the contacts 6 differently then. It is possible to use contacts 6 as part of said user control 8. User control 8 furthermore comprises a shorting member 12, which, at the same time, can be an elastic member 14. Optionally, user control 8 comprises, as shown in FIG. 2, a tactile member 28, which also can, at the same time, be an elastic member 14.

Shorting member 12 shall change (e.g., create or interrupt) and electrical current, e.g., by creating an electrical connection, in particular a short, when user control 8 is operated. Elastic member 14 shall reset user control 8 into its original position after it has been operated. Tactile member 28 shall allow a user to find a suitable spot for operating user control 8 without looking, typically solely be touching and sensing with a finger. Tactile member 28 can therefore comprise a protrusion and/or is made of or covered with a material that is different from neighboring portions of the outside of the hearing device.

As indicated by the dashed hand symbol, a user of the hearing device can press user control 8, with the effect that shorting member 12 is moved towards the contacts 6 (cf. the dashed line) and provides for an electrical connection between said contacts 6. Accordingly, user control 8 forms a switch. It is to be noted that in typical embodiments, the size of a user's fingertip would, if drawn to scale in FIG. 2, be much larger than the hand symbol and also much larger than the user control 8.

The user applies a force to user control 8 by pressing onto elastic member 14, which can be substantially made of an elastomer such as silicone. Where the elastic member 14 forms the shorting member 12, it can be substantially made of a conductive polymer; alternatively, the elastic member 14 could be covered with an electrically conductive layer.

Preferably, the deformation, which is applied to the elastic member 14 is an elastic deformation, so that the energy provided by the user by pressing the user control 8 is, with no or little loss, stored in the elastic member 14 and can cause the elastic member 14 to regain its original shape after the user stopped pressing. Thus, a pushbutton which can be easily operated many times, can be realized.

Since the contact pins 6 are anyway connected to the electronic circuitry of the hearing device, it is, with only little effort, possible to detect that user control 8 has been operated, e.g., by detecting that the electrical resistance between the two contact pins 6 drops, or that it is low or that is rises (when the user stopped pressing).

Accordingly, user control 8 can be used as a means for the user to provide input to the hearing device during normal operation of the hearing device. E.g., upon operating user control 8, another hearing program could be selected, or the output volume could be increased (or decreased). It will usually also be helpful to generate an acknowledge signal such as a beep when user control 8 is operated, so that the user is informed when he successfully operated user control 8.

The embodiment of FIG. 2 is a rather simple embodiment. The FIGS. 3 to 11 show a more elaborated embodiment of the invention.

Figure 3:
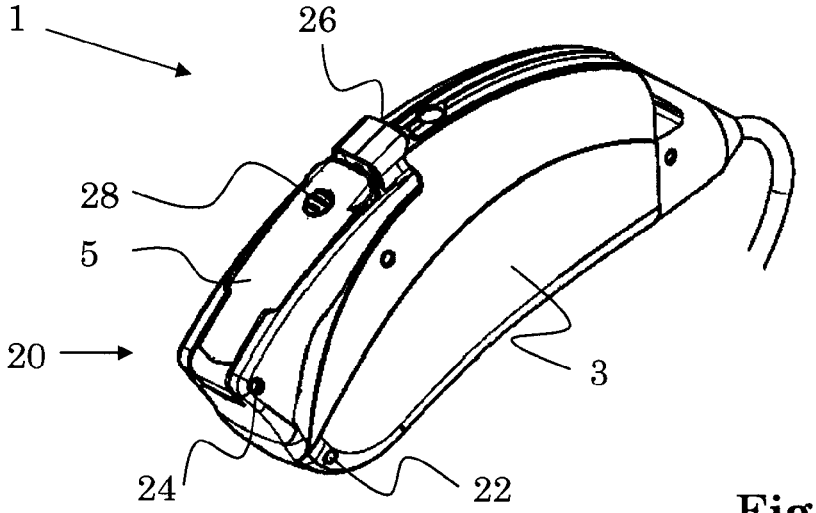
FIG. 3 a hearing device, perspective view.

FIG. 3 shows a hearing device 1 in a perspective view. The hearing device of FIG. 3 is a BTE hearing device, e.g., a BTE hearing-aid device.

The hearing device 1 has a housing 3, which comprises a battery door 20, which can be opened by a user by pulling an opening member 26. Battery door 20 is pivotable about a pivot joint 22. In hearing device 1, a user control is integrated, parts of which are integrated in a lever 5 comprised in battery door 20. Lever 5 is pivotable about a pivot joint 24. Also a tactile member 28 integrated in lever 5 is visible in FIG. 3.

Figure 4:
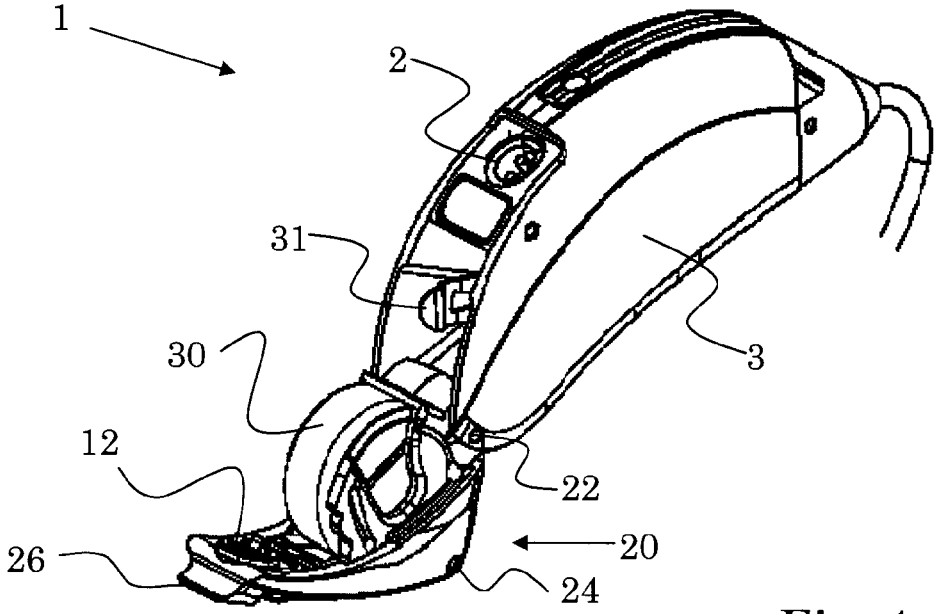
FIG. 4 a hearing device with open battery door, perspective view.

FIG. 4 shows the hearing device 1 of FIG. 3 with open battery door 20 in a perspective view. With the battery door 20 open, a user can replace a battery 30, which, when battery door 20 is closed, is electrically contacted by a battery contact 31. A connector 2 of the hearing device, e.g., a CS44 socket, is uncovered when the battery door 20 is open. In this state, a plug could be connected to connector 2. One or more contacts of connector 2 belong—in the normal state of the hearing device with battery door 20 closed—to said user control, as does a shorting strip 12 integrated in said lever 5.

Figure 5:
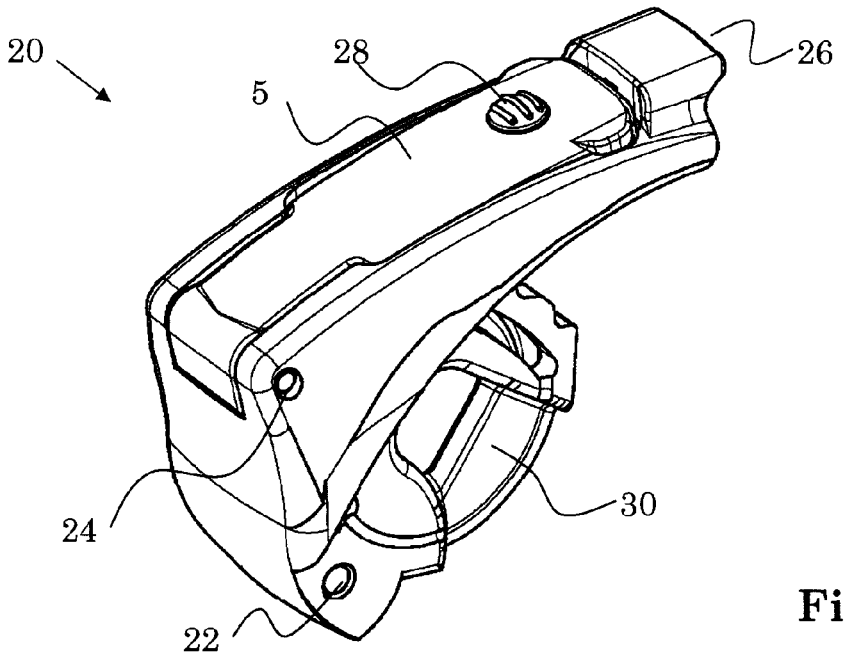
FIG. 5 a battery door, perspective view.
Figure 6:
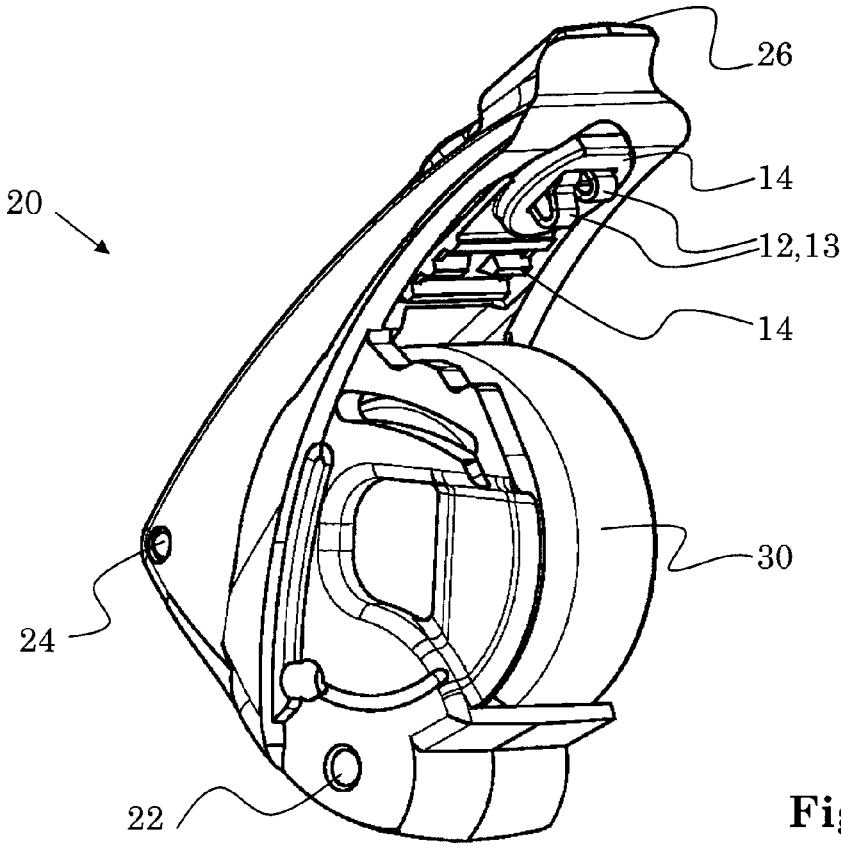
FIG. 6 a battery door with details of user control visible, perspective view.

FIGS. 5 and 6 show the battery door 20 of FIGS. 3 and 4 in a perspective view, wherein in FIG. 6, parts of the user control are better visible. Shorting strip 12 comprises two contact legs 13. An elastic member 14 of the user control has different sections and is also shown in FIG. 6.

Figure 7:
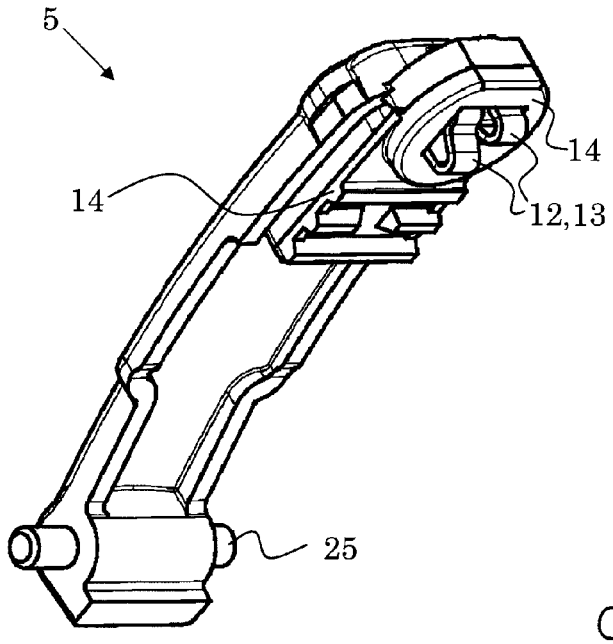
FIG. 7 a lever with details of user control visible, perspective view.
Figure 8:
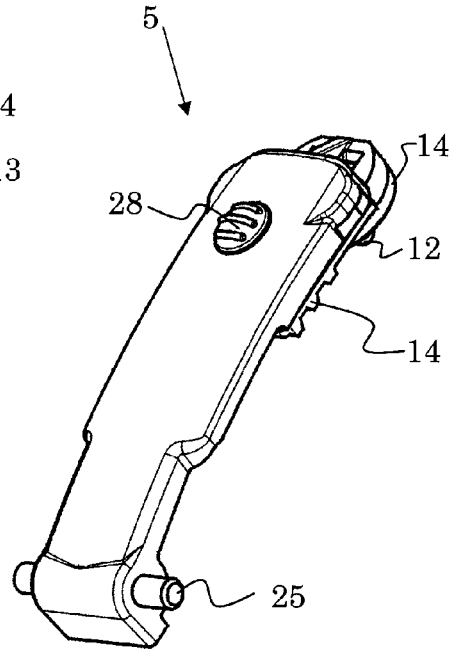
FIG. 8 a lever with details of user control visible, perspective view.

FIGS. 7 and 8 show the lever 5 of FIGS. 3 to 6 in a perspective view. It comprises a pivot pin 25. Thus, when a user operates the user control by pressing near the distal end of the lever 5 (preferably at or near the tactile member 28), the corresponding lateral force is converted by the lever 5 into a rotation of the lever 5.

Figure 9:
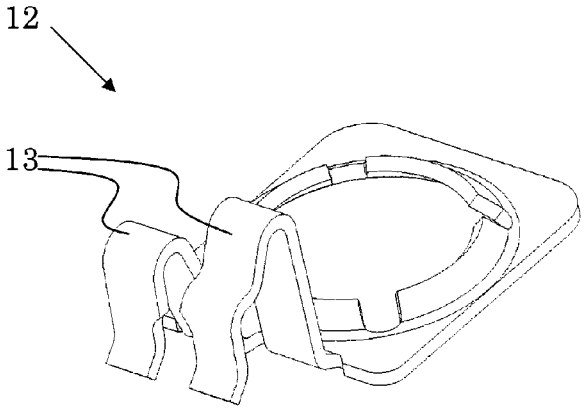
FIG. 9 a shorting member, perspective view.

FIG. 9 shows the shorting member 12 of FIGS. 4 to 8 in a perspective view. It is made from a piece of sheet metal such as a sheet of copper, beryllium copper or stainless steel, and comprises two contact legs 13. In addition, a portion of the shorting member 12 is used for fixedly attaching shorting member 12 to lever 5.

The two contact legs 13 are bend and are deformable independent of each other. They are elastically deformable, so as to provide for a safe electrical contact even if the position of contact leg to a contact to be contacted deviates from the optimum distance, e.g., due to manufacturing tolerances. The contact legs 13 are cantilevered strips of metal.

Figure 10:
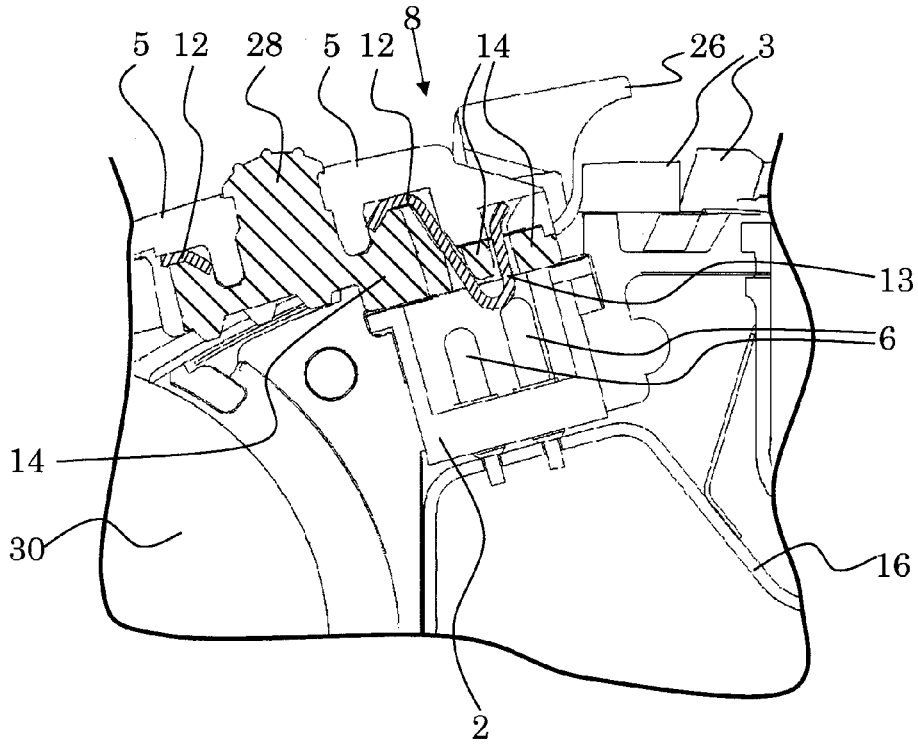
FIG. 10 a perspective view onto a cross-section through a detail of a hearing device, showing connector and user control.
Figure 11:
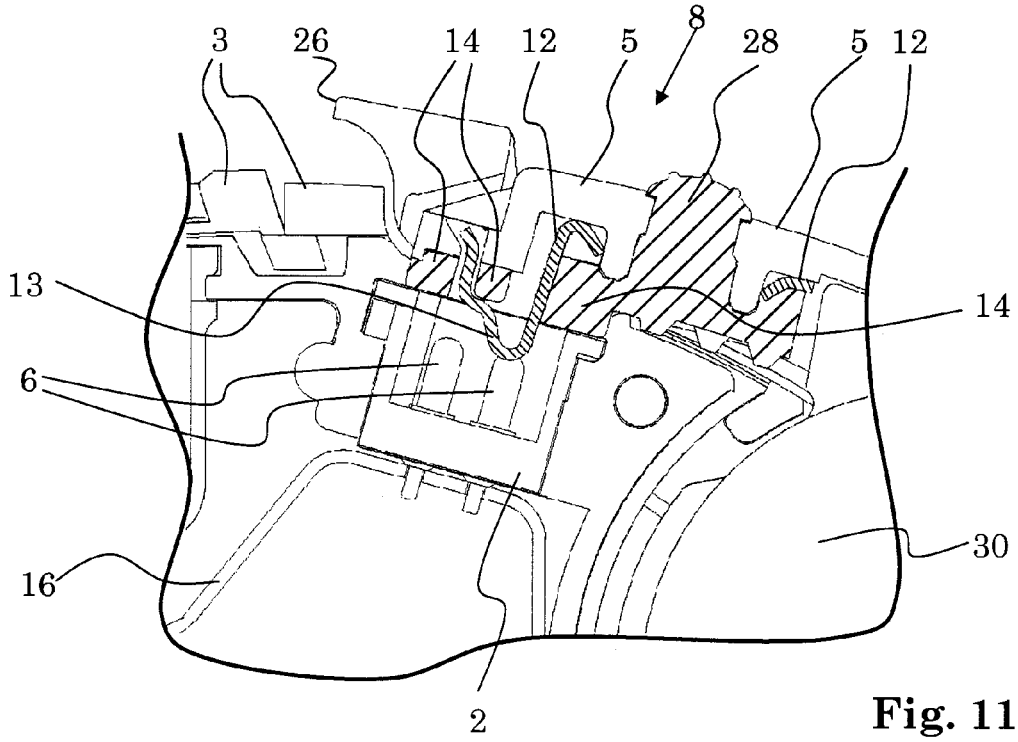
FIG. 11 a perspective view onto a cross-section through a detail of a hearing device, showing connector and user control.

FIGS. 10 and 11 show a perspective view onto a cross-section through a detail of the hearing device which or a portion of which is shown in FIGS. 3 to 9, showing connector 2 and user control 8 while user control 8 is operated, i.e. while the user presses lever 5.

FIG. 10 is a perspective view onto a cross-section through that contact leg 13, which is shown to the left side in FIG. 9, and FIG. 11 is a perspective view onto a cross-section through that contact leg 13, which is shown to the right side in FIG. 9.

For increased clarity, shorting member 12 has been hatched, where it is in the plane of the cross-section, and the elastomer forming the elastic member 14 and tactile member 28 has also been hatched, where it is in the plane of the cross-section, in both, FIG. 10 and FIG. 11.

Shorting member 12 is held in such a way that both legs 13 can be bend independently and easily, so as to prevent plastic deformation. As can be seen, the contact pins 6 are contacted near the top of the pin, which has the advantage that this area does not coincide with that part of the contact pin contacted when a plug is attached to connector 2. Furthermore, as can be seen, the contact legs are contacting the contact pins 6 not centrally, but off-center. This provides for an improved insensitivity against play and manufacturing tolerances. The shorting member 12 is designed and arranged such that it slides along the electrical contacts 6 when user control 8 is operated. This helps to remove debris and corrosion from the contact legs 13 and from the electrical contacts 6, thus ensuring a good and safe contact over a long time.

The shorting path created when operating user control 8 runs from one contact 6 to one contact leg 13, to the other contact leg 13 and to the other contact 6. By designing and arranging the shorting member 12 suitably, it is possible to electrically contact exactly one or more pre-selected contacts 6 of the connector 2.

The elastomer body drawn with hatching has a portion approximately underneath the tactile member 28, for preventing the application of too large forces to user control 8, which could plastically deform the shorting member 12. It can also help to move the lever 5 back into its original position. The tactile member 28 is preferably arranged close to and even above the contact legs 13. A portion of the elastic member 14 seals the connector 2, thus preventing connector 2 (and the shorting member 12) from being corroded by cerumen or sweat or hair care products.

The forces which are envisaged for operating the user control 8 are typically between 0.1 N and 2 N. Angular movements of lever 5 are typically between 0.1° and 3°. It has been found that these are parameters well suitable at least for BTE hearing devices.

Instead of creating a shorting path between two electrical contacts of connector 2 by operating the user control 8, it would also be possible to interrupt an existing electrical connection by operating the user control 8. It would also be possible to use more than two contacts of connector 2, or to use only one contact of connector 2. In the latter case, typically one additional contact elsewhere would be involved. It is also possible to use one contact leg for more than one contact of the connector. It would also be possible to create a less drastic change in resistance upon operating the user control. More generally, a flow of electrical current through said at least one electrical contact is changed, wherein changing comprises increasing and decreasing and creating and suppressing. Note that there will always be a—possibly very tiny—electrical current when detecting a current, a voltage or a resistance.

Instead of integrating the user control in a lever integrated into a battery door, the user control could also be realized separately from a battery door, and also without a lever.

An advantage of making the user control operable by a lever can be to make use of the mechanical advantage occurring by arranging the location at which the user control is operated (e.g., defined by a tactile member) and the location at which electrical contact are changed (e.g., at contact legs of a shorting member) at different distances to a pivot joint of the lever.

In a hearing device design, e.g., as illustrated in FIGS. 3 to 11, it can be advantageous to have only one opening member 26 by means of which both, the battery door and the covering element of the connector 2, are opened, because on the one hand, only one opening member has to be provided for, whereas an additional opening member would usually require additional space, thus enlarging the size of the hearing device, and on the other hand, the opening member 26 can be located farther away from the battery door's pivot joint 22, thus only little force for opening the battery door 20 is required.

The invention allows to integrate functionality into a hearing device with no or only little increase of the size of the hearing device, and it allows to provide the hearing device with functionality that does not have to be placed in a remote control for the hearing device.

LIST OF REFERENCE SYMBOLS

1 hearing device
2 connector, socket
3 housing
4 plug
5 lever
6 electrical contact, contact pin
8 user control, switch, pushbutton
10 circuitry, hearing device circuitry, hearing device electronics
12 shorting member
13 contact leg
14 elastic member
16 connection
18 connection
20 battery door
22 pivot joint
24 pivot joint
25 pivot pin
26 opening member
28 tactile member
30 energy supply member, battery
31 battery contact

What is claimed is:

1. Hearing device comprising:

a battery door for covering an energy supply member within said hearing device during normal operation of the hearing device and for allowing access to said energy supply member, said battery door comprising a covering member comprising a pivot joint;

a connector adapted for receiving a plug;

a user control comprising an elastic member which is compressed when said user control is operated, wherein the user control is comprised in the covering member that covers the connector during operation of the hearing device and the covering member rotates about the pivot joint when the user control is operated and the elastic member is compressed; and at least two electrical contacts, wherein said electrical contacts are components of said connector and the same electrical contacts of said connector are used as electrical contacts for operating said user control, and wherein the connector is covered when the battery door is closed and uncovered such that the plug may be connected to the connector when the battery door is open.

2. The hearing device according to claim 1, wherein said connector is a connector for providing a communication connection to said hearing device.

3. The hearing device according to claim 1, wherein said connector comprises a socket.

4. The hearing device according to claim 1, wherein said user control is integrated in the hearing device during normal operation of the hearing device.

5. The hearing device according to claim 1, wherein said user control comprises a switch.

6. The hearing device according to claim 5, wherein said switch is a pushbutton.

7. The hearing device according to claim 1, wherein said user control comprises a shorting member for shorting said at least two electrical contacts when operated.

8. The hearing device according to claim 1, wherein said elastic member is deformed when said user control is operated for resetting said user control into its original position.

9. The hearing device according to claim 8, wherein said elastic member comprises a body substantially made of an elastomer.

10. The hearing device according to claim 8, wherein said elastic member forms a seal sealing said connector during normal operation of the hearing device.

11. The hearing device according to claim 1, wherein said hearing device comprises a housing comprising said covering member to which a portion of said user control is attached and said covering member is pivoted when said user control is operated.

12. Method of operating a hearing device with a battery door for covering an energy supply member within said hearing device during normal operation of the hearing device and for allowing access to said energy supply member, said method comprising the steps of:

using at least two electrical contacts being components of a connector of said hearing device, wherein said connector is adapted for receiving a plug, the same electrical contacts of said connector are used as electrical contacts for operating a user control of said hearing device; and establishing or interrupting an electrical connection between the two electrical contacts of said connector by closing a battery door comprising a covering member comprising a pivot joint, covering the connector, and operating said user control comprising an elastic member which is compressed when said user control is operated, wherein said user control is comprised in the covering member that covers the connector during operation of the hearing device, wherein said operating said user control comprises rotating the covering member about the pivot joint and compressing the elastic member, and wherein the connector is covered when the battery door is closed and uncovered such that the plug may be connected to the connector when the battery door is open.

13. The method according to claim 12, wherein said user control is integrated in the hearing device during normal operation of the hearing device.

14. The method according to claim 12, comprising the steps of:

establishing an electrical connection between at least two electrical contacts of said connector by operating said user control, which operating causes a shorting member of said user control to electrically contact said at least two electrical contacts; and detecting said establishment of said electrical connection.

15. The method according to claim 14, wherein said user control comprises a pushbutton, and wherein said operating said user control comprises pushing said pushbutton.

16. The hearing device according to claim 1, wherein said covering member is connected to a housing of the hearing device to form a part of the housing.

17. The hearing device according to claim 1, wherein said at least two electrical contacts are connected for reading data from the hearing device or for loading data into the hearing device.

18. A system for operating a hearing device comprising:

a battery door for covering an energy supply member within said hearing device during operation of the hearing device and for allowing access to said energy supply member, said battery door comprising a covering member comprising a pivot joint;

a connector adapted for receiving a plug;

a user control comprising an elastic member which is compressed when said user control is operated, wherein the user control is comprised in the covering member that covers the connector during operation of the hearing device and the covering member rotates about the pivot joint when the user control is operated and the elastic member is compressed;

at least two electrical contacts; and hearing device circuitry connected to said at least two electrical contacts for reading data from the hearing device or for loading data into the hearing device wherein said electrical contacts are components of said connector and the same electrical contacts of said connector are used as electrical contacts for operating said user control, and wherein the connector is covered when the battery door is closed and uncovered such that the plug may be connected to the connector when the battery door is open.

* * * * *

UNITED STATES PATENT AND TRADEMARK OFFICE

CERTIFICATE OF CORRECTION

PATENT NO. : 8,477,977 B2
APPLICATION NO. : 12/530651
DATED : July 2, 2013
INVENTOR(S) : Paul C. Aquilina It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 303 days.

Signed and Sealed this
Eighth Day of September, 2015

Michelle K. Lee

Michelle K. Lee
*Director of the United States Patent and Trademark Office*